US005428848A

United States Patent [19]

Battle

[11] Patent Number: 5,428,848

[45] Date of Patent: Jul. 4, 1995

[54] FLUSH REGULATOR

[76] Inventor: John R. Battle, 11306 W. Pool Ct., Crystal River, Fla. 32629

[21] Appl. No.: 272,093

[22] Filed: Jul. 8, 1994

Related U.S. Application Data

[60] Continuation of Ser. No. 105,966, Aug. 13, 1993, Pat. No. 5,333,331, which is a division of Ser. No. 907,649, Jul. 2, 1992, Pat. No. 5,237,710.

[51] Int. Cl.[6] ..... E03D 1/33

[52] U.S. Cl. ..... 4/324; 4/394

[58] Field of Search ..... 4/227.4, 324, 325, 392, 4/393, 394, 395, 403, 404

[56] References Cited

U.S. PATENT DOCUMENTS

| | | | |
|---|---|---|---|
| 4,032,997 | 7/1977 | Phripp et al. | 4/324 X |
| 4,240,167 | 12/1980 | Gilliland | 4/324 |
| 4,455,694 | 6/1984 | Dymon | 4/325 |
| 4,536,900 | 8/1985 | Hayes | 4/324 |
| 5,023,960 | 6/1991 | Ratanagsu | 4/393 |
| 5,142,710 | 9/1992 | Olson | 4/325 |
| 5,205,000 | 4/1993 | Xia et al. | 4/324 |

*Primary Examiner*—Robert M. Fetsuga
*Attorney, Agent, or Firm*—A. W. Fisher, III

[57] ABSTRACT

A flush regulator selectively operable in partial flush mode or a full flush mode for use with a water closet including a water storage tank having a flush drain aperture formed in the lower portion thereof and a buoyant flapper valve disposed to selectively seal the flush drain aperture movable between an open and closed position by a flush handle movable between a first and second position to selectively control the flow of water through the flush drain aperture, the flush regulator comprising a buoyant flush assembly movably disposed within the water closet including a float chamber to control the buoyancy of the buoyant flush assembly and a dispensing chamber configured to operatively house a bleach/detergent therein such that when the flush handle is moved from the first position to the second position and released the float chamber engages the buoyant flapper valve in the open position to force the buoyant flapper valve to prematurely return to the closed position to operate in the partial flush mode and when the flush handle is moved from the first position to the second position and held in the second position the buoyant flapper valve is held in the open position to operate in the full flush mode and wherein when the flush handle is moved from the first position to the second position and released a portion of the bleach/detergent disposed within the dispensing chamber is dispersed into the water storage tank. Several embodiments are disclosed.

3 Claims, 10 Drawing Sheets

FLUSH REGULATOR

CROSS REFERENCE

This is a continuation application of application Ser. No. 08/105,966, filed Aug. 13, 1993, Pat. No. 5,333,331, which is a divisional application for allowed application Ser. No. 07/907,649, filed Jul. 2, 1992, Pat. No. 5,237,710.

BACKGROUND OF THE INVENTION

1. Field of the Invention

A flush regulator for use with a water closet to selectively control the flow of water therefrom.

2. Description of the Prior Art

Numerous devices have been developed to conserve flush water selectively operable in either a full flush or a partial flush.

Typically toilets include a tank mounted above the toilet bowl with bottom outlet in the tank. A flapper valve normally closes the outlet so that the tank can be filled. A float closes the valve when the selected water level is reached.

Toilets are designed so that a more than adequate amount of water is delivered to the bowl with each flush. Thus water can be saved by adjusting the amount of flush water discharged to accommodate for individual design and installation.

Furthermore, there exists a need for dispensing a bleach, detergent, dye or the like on an automatic basis into the toilet bowl.

U.S. Pat. No. 4,032,997, shows a flush regulator for use in a toilet flush tank to regulate the outflow from the flush tank through an outlet pipe including a water chamber means opening upwardly and an air chamber means opening downwardly. The chamber means are symmetrically arranged with respect to the mounting portion.

U.S. Pat. No. 3,156,930, describes a water saver for flush tank toilets wherein the pressure plate acts directly against the tank outlet valve such that the weight of the pressure plate causes the premature closing of the valve. The weight of the pressure plate acts to swing the valve downwardly more quickly than would otherwise be the case in the event the pressure plate is not held in operative position.

U.S. Pat. No. 2,773,268, teaches a flushing apparatus including a tank having a bottom wall with an aperture therethrough forming a valve seat therein. The tank is configured to contain a liquid and includes a pivot connection therein spaced horizontally from the aperture. A valve member is positioned in overlying relation to the valve seat operable to control the discharge of liquid from the tank; while a valve actuating means comprising a bell crank lever with a first arm extends in a substantially horizontal plane and a second arm extending upwardly from and at an acute angle to the first arm. The bell crank lever includes a float member secured thereto. A container is secured to the second arm with a closed end adjacent to the tank bottom wall, with the valve member being secured to the first arm. The bell crank lever is pivotally secured to the tank pivot connection so that the center of gravity of the valve assembly is in overlying relation to the valve seat when the tank and the container are substantially filled with liquid thereby urging the valve member toward a closed position and means to pivotally rotate the bell crank lever so that the center of gravity of the valve assembly will move to the opposite side of the pivot connection away from the valve seal thus maintaining the valve member in an open position such that the valve assembly is operable upon decrease in liquid level in the container to urge the valve member toward a closed position.

U.S. Pat. No. 3,142,846, shows a flush valve for a flush tank with a discharge tube having a valve seat at the upper end thereof and an overflow tube connected to the discharge tube and offset therefrom. The valve comprises a pair of spaced pivot elements located on opposite sides of the overflow tube, a U-shaped lever having its legs pivotally mounted on the pivot elements so as to straddle the overflow tube, a valve member carried by the U-shaped lever below the bight of the U and being normally adapted to seal against the valve seat and a hollow container mounted on one leg of the U-shaped lever and being positioned to move in a plane laterally offset from the overflow tube so that there is no engagement between the hollow container and the overflow tube. The container has a restricted discharge orifice for providing a time delay between the time when the valve is first opened and the time when the valve recloses.

U.S. Pat. No. 1,126,080, describes a flush tank having a valve seat in the bottom thereof with a valve in the seat, of a buoyant arm pivotally supported at one end and having its other end connected directly to the valve and means for unseating the valve.

U.S. Pat. No. 3,302,217, teaches an apparatus for actuating a flush valve on a water closet having a bowl and a tank for holding water which is discharged from the tank into the bowl to flush the bowl wherein the valve controls the flow of water from the tank into the bowl. The valve is opened manually causing gravity discharge of water from the tank into the bowl. When the tank has been emptied the valve closes and the tank is automatically refilled with water. The apparatus holds the valve open while the tank is being discharged and permits the valve to close when the desired low liquid level in the tank has been reached. The apparatus comprises a closed cylinder which is divided into two bodies by a partition which extends diametrically across the interior of the cylinder. The cylinder is mounted for rotation about its central axis on a horizontally extending shaft which may be mounted on a conventional overflow pipe with which water closet tanks are conventionally provided. When in position, the cylinder is below the top level of liquid in the tank and above the flush valve. A chain connects a conventional flush lever to a point on the periphery of the cylinder and extends from that point to the flush valve which controls the flow of water from the tank into the water closet bowl. The length of the chain between the cylinder and the valve is such that when the valve is held closed by pressure of water in the tank, the partition within the cylinder is approximately horizontal, so that there is a hollow body above the axis of rotation of the cylinder and a second body beneath the axis of rotation which comprises material having a density less than the density of water or which may be hollow. The lower body, if hollow, is empty and is both air and water tight. The upper hollow body has openings in its periphery so that when the water in the tank is at its top operating level, the upper hollow body is filled with water. When the flush lever is manually actuated, the chain connecting it with the cylinder is pulled, causing the cylinder to rotate about its horizontal axis approximately 90° in a direction to open the valve. In this position of the cylinder the partition is approximately vertical and the two bodies are on opposite sides of the axis of rotation. So long as the water in the tank is above the bottom of the cylinder, the body having a density less than that of water will tend to rise in the water and thereby keep the valve open. When the water level in the tank drops beneath the bottom of the cylinder, the weight of the water in the water filled hollow body will tend to rotate the cylinder in the same direction, keeping the valve open. There are three openings in the hollow body containing water and they are positioned in the periphery of the body so that when the cylinder has been rotated to open the valve and the partition within the cylinder is approximately vertical, there is one opening at the top of the hollow body, one opening at its bottom and one opening in its side. Therefore, as the level of the liquid in the tank falls past the cylinder, water flows out of the side and bottom openings. However, these openings are so sized that all of the water does not drain out of the hollow body until the water in the tank has reached the desired low level. At that point, weight of the valve will rotate the cylinder in the opposite direction approximately 90° and the valve will close and be held closed by water flowing into the tank when the float valve opens.

U.S. Pat. No. 3,908,203, describes a two-level flush mechanism with a single flap valve to control both major and minor flushes. This valve is connected to a float. When the valve is open and water is above the float the latter holds the valve open. When water level falls below float it pushes valve closed unless the user holds the valve open by continued holding of the flushing handle.

U.S. Pat. No. 3,775,778, shows a device to selectively discharge substantially all or only a major portion of the water within the flush tank of a toilet. The device includes a single operator shiftable in a first direction from a rest position for discharging substantially all of the water in the flush tank and in the opposite direction for discharging only a minor portion of the water within the flush tank.

U.S. Pat. No. 3,561,016, teaches a flush tank accessory selectively releasing substantially all or a preselected portion of the water held in a toilet tank by means of a float which is held a predetermined distance above the valve member for selectively supporting the member. The falling water level within the tank will therefore reduce the support on the valve when the water level reaches the float thereby causing the valve to close unless it is manually held open throughout the emptying of the tank.

U.S. Pat. No. 3,345,643, describes a cup arrangement for a flush-tank outlet valve temporarily weighted by water from the tank to regulate the escape of the weighting water discharged from the flush tank before the valve closes.

U.S. Pat. No. 3,921,226, shows a flush valve regulator for the discharge control valve of a toilet storage comprising a float cup with a recess in the lower end thereof configured to seat on the discharge valve. The regulator is provided with a surrounding wall about the periphery of the bottom recess which encloses a top recess to be filled with water and has a sleeve extending through the float cup slidably receiving the stem of the discharge valve. When the stem is held in a raised position for a predetermined period of time, the entire contents of the storage tank is discharged. However, if the valve stem is lifted to start the discharge and then immediately released, the valve will be seated by the action of the float cup thereon and thus trap a part of the water in the tank to prevent its discharge.

U.S. Pat. No. 3,553,740, shows a float controlled valve for a flushing cister including an open water level determining vessel in which the float member is freely suspended so as to form a pressure water chamber within the open vessel below the float member to be charged with cistern replenishing water flowing over the rim of the open vessel as the cistern approaches full capacity whereby pressure is developed in the chamber to impart a quick short lift to the float member and float arm sufficient to close the valve, the water in the chamber being dischargeable in response to the succeeding flushing operation of the cistern.

U.S. Pat. No. 2,168,742, teaches a flush valve regulator comprising a tank having a flush outlet, a buoyant valve including a stem, means for guiding the stem and valve in reciprocable movements above the outlet, means for raising the stem and associated valve, stop means limiting upward movement above the flush outlet and a chamber on the stem submerged in the water of the tank. The chamber comprises vertically adjustable lower and upper shell members wherein the upper shell has apertures for admission of water into the chamber and the lower shell member has a bushing for frictional binding engagement upon the stem whereby the chamber may be adjusted longitudinally of the stem.

U.S. Pat. No. 3,325,828, describes a tilting discharge valve for a reservoir such as a toilet flush tank wherein the valve closure is carried at the base of an overflow tube adapted for pivotal mounting on the bottom of the reservoir, the tube carrying the lower portion thereof, a pair of oppositely disposed open-top chambers, one of the chambers being closed at the bottom and serving, when occupied by liquid, as a counter-balance, while the other chamber has manually adjustable discharge means for controlling the speed of discharge of the reservoir. A buoyant air-trapping chamber is provided to accelerate the opening of the valve.

U.S. Pat. No. 2,260,078, teaches a tank valve comprising a flexible hollow body having a substantially inverted cone-shaped lower portion wherein the lower portion has an open lower end an upturned reinforcing flange formed around the open lower end and spaced from the sides of the body to provide a water-receiving channel into which water flowing by the valve will impinge to pull the inverted cone-like portion tightly upon a valve seat.

U.S. Pat. No. 2,214,439, describes a float valve comprising a stem, hollow valve fixed on the lower end, adjustable means to maintain water at a predetermined level in the valve and a float adjustable vertically on the stem. The valve consisting of a hollow elastic body, as a means for maintaining a water level therein consisting of a tube engaged slidably through the lower part of the valve. The float comprises a chamber having a closed bottom and head and receiving head stem slidably therethrough. The stem being threaded, nuts being engaged upon the stem over and under the float and means to seal the float around the stem.

U.S. Pat. No. 18,330, shows a flushing apparatus for a tank having a water inlet and a water outlet, a valve adapted to normally close the outlet, a float arranged within the tank and adapted to elevate the valve and release the contents of the tank, movable means for normally retaining the float in inoperative position and another float supported independently of and adapted to trip the means when the contents of the tank have reached a pre-determined level, the movements of the float and the means being in unison solely during the tripping operation.

U.S. Pat. No. 3,790,968, describes a pair of laterally spaced float members supported on the lifting rod or valve stem at an adjusted or preferred elevation above a nonbuoyant and weighted valve member threadedly attached to the lower end of the rod or stem. The valve member will operate in conjunction with either a flat or slanted valve seat. Smaller seats can also be accommodated by merely selecting an intermediate angular position of the valve member on the valve stem.

U.S. Pat. No. 2,241,220, shows a flushing tank having an outflow passage and a valve for closing the passage. The valve is configured to seat by gravity and a float for the valve adapted to drop with the level of the water in the flush tank to positively retard the seating of the valve until the water in the tank is level with the outflow passage. The float comprises a housing forming an air chamber for floating on the water in the tank having adjustable bracket connecting the float to the valve to adjust the float to the desired seating action of the valve.

U.S. Pat. No. 4,296,503, describes an apparatus for deodorizing and cleansing a toilet bowl in which a cake is floated on the surface of the water in the hold tank. The container retaining the detergent is adapted to drop as the water is exhausted during flushing to dispense the perfumed detergent into the water.

U.S. Pat. No. 4,370,763, shows an apparatus for dispensing bleach or detergent into a toilet tank or the like on a controlled basis comprising a dispenser immersed in the tank water subdivided into two approximately equal volume chambers. One chamber contains the bleach and the other contains a dye and a detergent. The internal structure is such that a metered dose of a liquid solution formed from a block or cake of detergent or bleach is automatically dispensed each time the toilet is flushed.

U.S. Pat. No. 2,736,039, discloses a flush tank having a high liquid level and a low liquid level, a vertical conduit having a lower discharge end disposed above the low liquid level of the tank together with upper and lower valve members carried by the conduit and disposed between the upper and lower liquid levels. Each of the valve members includes a float, said upper valve member being in its open position when its float is raised and closed when its float is lowered and the lower valve member being open when its float its float is lowered and open when its float is raised. A detergent supply is connected to the upper end of the conduit for supplying a detergent into the conduit past the upper valve member and up to the lower valve member when the water in the tank is up to its high liquid level. The upper valve member is closed and as the lower valve member is open as the water in the tank recedes to its low level whereby a detergent retained between the valve members will into the tank as the water in the tank recedes to its low liquid level.

U.S. Pat. No. 4,514,866, teaches a buoyant dispenser for delivery of a metered quantity of a dispensble material comprising a container having a central receptacle to hold the dispensable material, buoyancy means such as pontoons straddling the receptacle, a cover in fluid-tight engagement with the receptacle, an attitude guide means attached to the container that is adapted to be anchored to a wall of the fluid reservoir and a metering means in fluid registry with the receptacle to permit controlled ingress and egress of the fluid and dispensable material. Preferably the metering means comprises a pair of holes disposed in spaced apart relation to each other and positioned to allow a predetermined quantity of dispensable material to escape from the receptacle. In one embodiment, the receptacle is divided into two compartments by a transverse partition and the metering means comprises holes communicating with one of the compartments so that the dispensable material in that compartment is discharged when the dispenser is in the fully floating position. The present dispenser finds particular utility in fluid reservoirs having cyclically variable fluid levels and is particularly suiteds for use in the water tank of a domestic toilet apparatus.

U.S. Pat. No. 4,915,260, shows a float controlled dispenser capable of segregating active ingredients and dye and selectively releasing a predetermined amount of each into the tank of a toilet. The dispenser comprises a float operated dispenser having the fluid disinfectant in the main body of the dispenser and the dye in a separate portion of the dispenser. A mixing chamber communicating with the tank water is provided beneath the float so that, on the upstroke, water rising in the chamber serves to dissolve the dye and raise the float. A solution of dye and water is retained in the mixing chamber. During the flush cycle, as the float is lowered on the downstroke due to a decreasing water level in the tank, a measured amount of disinfectant is released from the body of the dispenser into a metering chamber on the float. As the float rises with the water level and seals the dispenser orifice, this measured amount is transferred to the surrounding tank. The dye mixture retained in the chamber is dispensed on the downstroke, at which time the decreasing water level in the toilet tank draws the mixture from the chamber into the tank.

U.S. Pat. No. 4,530,118, teaches a passive dispenser for containing a quality of solution isolated from a body of liquid and for causing a predetermined volume of solution to issue from the dispenser solely under conditions of gravity flow in response to the level of the body of liquid being lowered from a first elevation to a second elevation. The dispenser comprises an upper section which is a cuplike member having an open bottom the lower peripheral edge being an annular channel, a lower section which is a cuplike member having an open top. The cuplike members provide an internal reservoir for storage of cleaning solution formed upon dissolution of a water-soluble cake contained with said reservoir. The top peripheral edge of the lower section is disposed within the annular channel to define a discharge/refill conduit connecting the reservoir with the body of liquid and comprising two chambers in fluid communications with each other. One chamber is adjacent to the reservoir to form an air trap chamber and the other is adjacent to the body of liquid to form an air refill chamber. A transfer port connects the air trap and air refill chambers.

U.S. Pat. No. 3,913,151, discloses an apparatus for dispensing a metered quantity of deodorizing and/or cleansing liquid into a toilet bowl comprising a liquid-containing reservoir inside the toilet tank. The reservoir includes a metering chamber with input and exit ports respectively actuated by a pair of nested floats which extend downwardly into the toilet tank and which are actuated, seriatim, by the rising level of water in the tank after each flush.

U.S. Pat. No. 5,142,710, shows a water saver for a toilet tank including a discharge control and flapper tank ball for controlling the flow of water from the tank or reservoir to the bowl. The water saver comprises a generally cylindrical configuration with an open top and a closed bottom defining a water retaining chamber extending upwardly above the flapper tank ball and being designed to retain a fill of a certain first quantity of water. Pivotal opening of the water saver while tipping a portion of the water outwardly of the enclosure will not discharge any appreciable amount of water so as to permit a more positive seal of the water saver resting on the top of the flapper tank ball which is upon the discharge drain opening.

U.S. Pat. No. 5,205,000, describes a dual water-level toilet flushing apparatus comprising an overflow tube sleeve that attaches to an overflow tube coupled to the back of a floating inverted pendulum and a pendulum/-flapper valve link. To effect a partial flush, the toilet flush handle is depressed and immediately released; to effect a full flush the handle is depressed and held for a few seconds.

SUMMARY OF THE INVENTION

The present invention relates to a flush regulator for use with a water closet configured to selectively operate in a partial flush mode or a full flush mode. The water closet includes a flush drain aperture and a buoyant flapper valve movable between an open and closed position by a flush handle movable between a first and second position to control the flow of water from the water closet through the flush drain aperture.

The flush regulator comprises a buoyant flush assembly movable between a first and second position including a float chamber comprising a hollow body partially filled with liquid to control the buoyance of the buoyant flush assembly and a dispensing means to operatively retain bleach/detergent therein operatively mounted within the water closet by a mounting assembly.

The mounting assembly comprises a mounting bracket disposed either concentrically or eccentrically relative to the pivot axis of the buoyant flapper valve with either a single or double pivot point.

In use, the float chamber is disposed to engage the buoyant flapper valve when the buoyant flapper valve is moved from the closed position to the open position as the flush handle is moved from the first position to the second position and released such that the flush regulator under the force of gravity will cause the buoyant flapper valve to prematurely return to the closed position to operate in the partial flush mode to discharge a first volume of water or when the flush handle is moved form the first position to the second position and is held in the second position the buoyant flapper valve is held in the open position to operate in the full flush mode to discharge a second volume of water. Furthermore, when the flush handle is moved from the first position to the second position and released a portion of the bleach/detergent from the dispensing means is dispersed into the water storage tank.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several view of the drawings.

DETAILED DESCRIPTION OF THE PREFERRED EMBODIMENT

Figure 1:
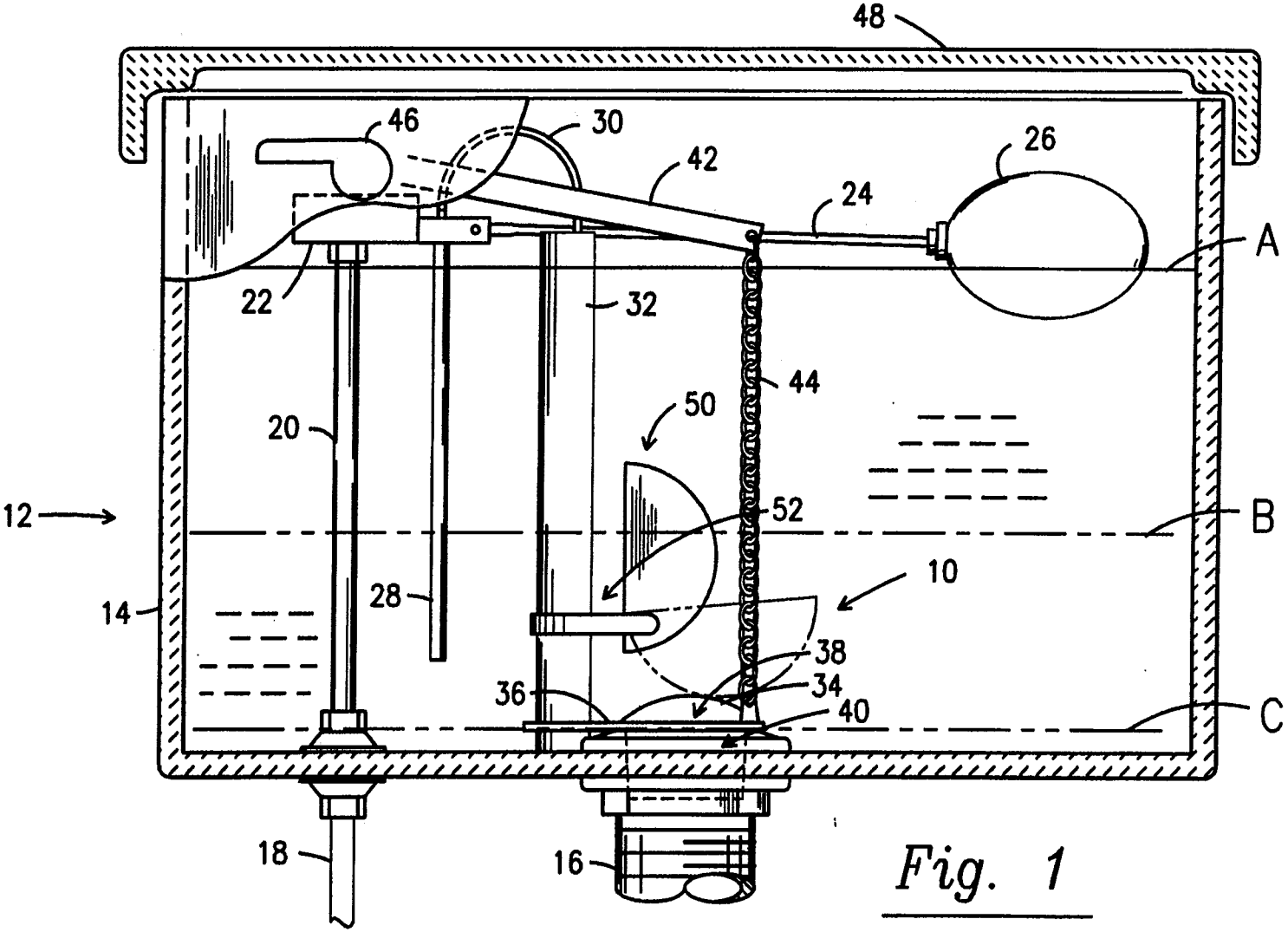
FIG. 1 is a cross-sectional front view of a water closet incorporating the flush regulator of the present invention.

As shown in FIG. 1, the present invention relates to a flush regulator generally indicated as 10 for use with a water closet generally indicated as 12 to selectively permit a full or partial flush of water from the water storage tank 14.

As shown in FIG. 1, the water storage tank 14 is coupled to a toilet bowl (not shown) by a flush conduit 16. The water storage tank 14 is connected to a conventional water system (not shown) by an external water supply conduit 18. An internal water supply conduit 20, disposed within the water storage tank 14, is coupled between the external water supply conduit 18 and a water supply control valve 22 of conventional construction. The water supply control valve 22 is coupled to a pivotally mounted control arm 24 having a float member 26 secured to the outer end thereof. The float member 26 tends to drop under the force of gravity to open the water supply control valve 22 without the support of water within the water storage tank 14. In conventional fashion as water is fed to the water storage supply tank 14, the float member 26 rises moving the pivotally mounted control arm 24 upwardly. When the water within the water storage tank 14 reaches a predetermined level shown as A in FIG. 1, the water supply control valve 22 closes preventing additional water to flow to the water storage tank 14 from the conventional water supply (not shown). The water supply control valve 22 is connected to a first and second water delivery conduit indicated as 28 and 30 respectively. During the fill cycle, water is fed directly to the water storage tank 14 through the first water delivery conduit 28 and to the second water delivery conduit 30 through an overflow tube 32.

As shown in FIG. 1, a buoyant flapper valve 34, coupled to the lower portion of the overflow tube 32 by an interconnecting member 36 and having an air chamber 38 formed therein, is disposed to normally seal a flush outlet 40 to selectively control the flow of water from the water storage tank 14 to the flush conduit 16. The buoyant flapper valve 34 is interconnected to one end of a pivotally mounted flush arm 42 by a flexible interconnecting element 44; while, the opposite end of the pivotally mounted flush arm 42 is coupled to a flush handle 46 as in a conventional system. A tank cover or top 48 is placed on the top of the water storage tank 14.

As shown in FIG. 1, the flush regulator 10 comprises a flush control means or assembly generally indicated as 50 coupled to the overflow tube 32 by a mounting means or assembly generally indicated as 52. As described more fully hereinafter, the flush regulator 10 may comprise a single or double, eccentric or concentric pivot with or without bleach/detergent dispensing means.

Figure 2:
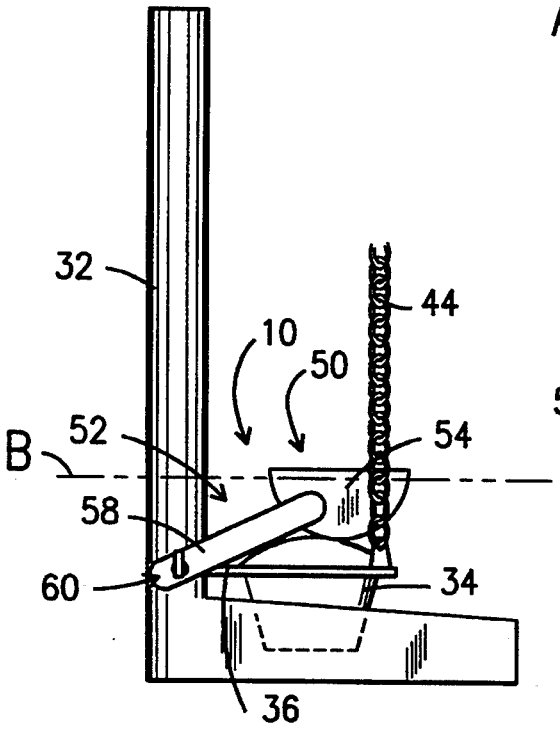
FIG. 2 is a side view of a concentrically mounted, single pivot flush regulator completing the partial flush cycle with the flush control means in the second or lower position.
Figure 3:
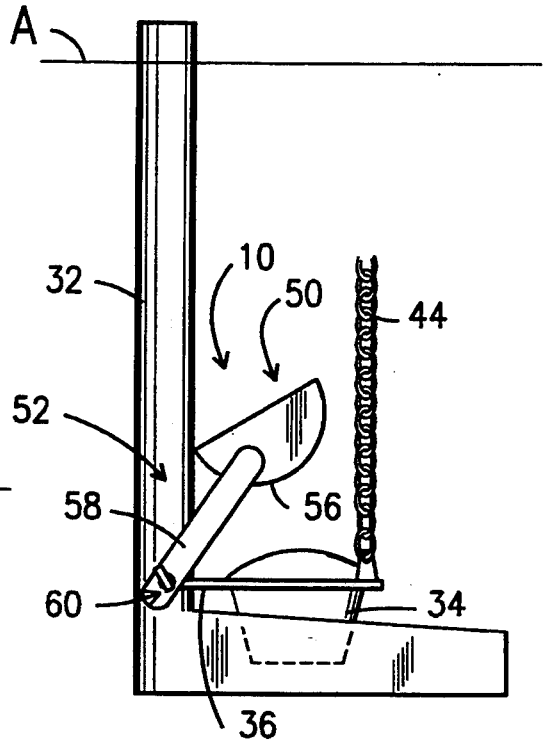
FIG. 3 is a side view of the concentrically mounted, single pivot flush regulator with the flush control means in the first or upper position when the water storage tank is fully charged.

FIGS. 2 and 3 show a concentrically mounted, single pivot flush regulator 10. Specifically, the flush control means 50 comprises a flush control member 54 including a lower convex surface 56 to engage the buoyant flapper valve 34 as described hereinafter and the mounting means 52 comprises at least one pivot arm 58 pivotally coupled at one end thereof to the overflow tube 32 by a first pivot means generally indicated as 60 in concentric alignment with the pivot axis of the flexible intermediate member 36 of the buoyant flapper valve 34 and fixedly coupled to the flush control member 54 at the opposite end thereof.

Figure 4:
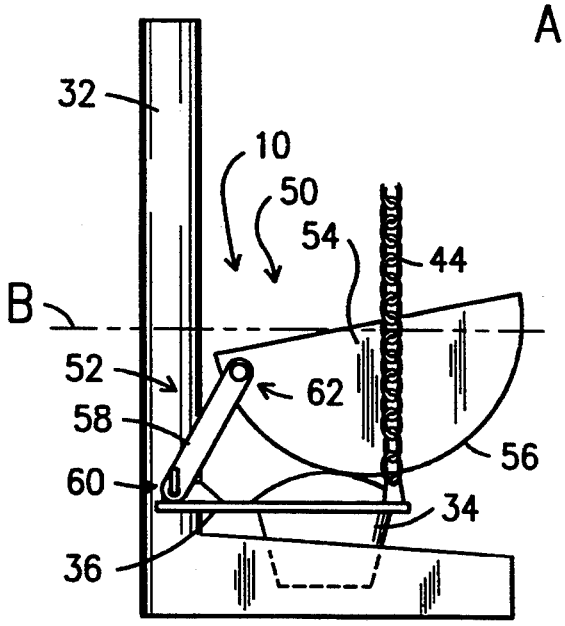
FIG. 4 is a side view of a concentrically mounted, double pivot flush regulator completing the partial flush cycle with the flush control means in the second or lower position.
Figure 5:
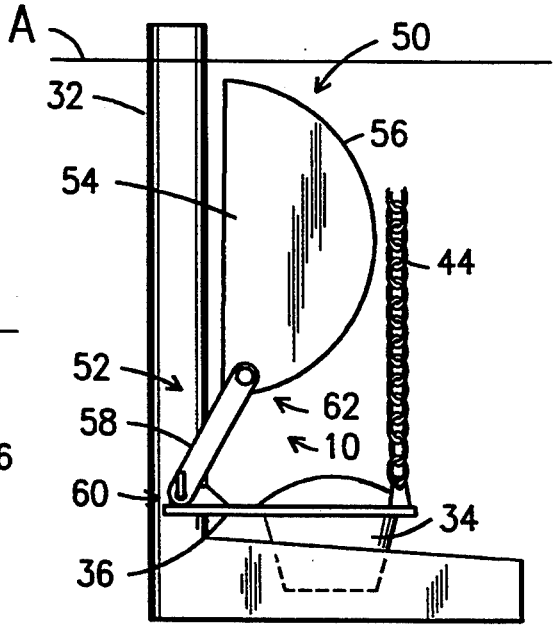
FIG. 5 is a side view of the concentrically mounted, double pivot flush regulator with the flush control means in the first or upper position when the water storage tank is fully charged.

FIGS. 4 and 5 show concentrically mounted, double pivot flush regulator 10. Specifically, the flush control means 50 comprises a flush control member 54 including a lower convex surface 56 to engage the buoyant flapper valve 34 as described hereinafter and the mounting means 52 comprises at least one pivot arm 58 pivotally coupled at one end thereof to the overflow tube 32 by a first pivot means generally indicated as 60 in concentric alignment with the pivot axis of the flexible intermediate member 36 of the flapper valve 34 and pivotally coupled to the flush control member 54 at the opposite end thereof by a second pivot means generally indicated as 62.

Figure 6:
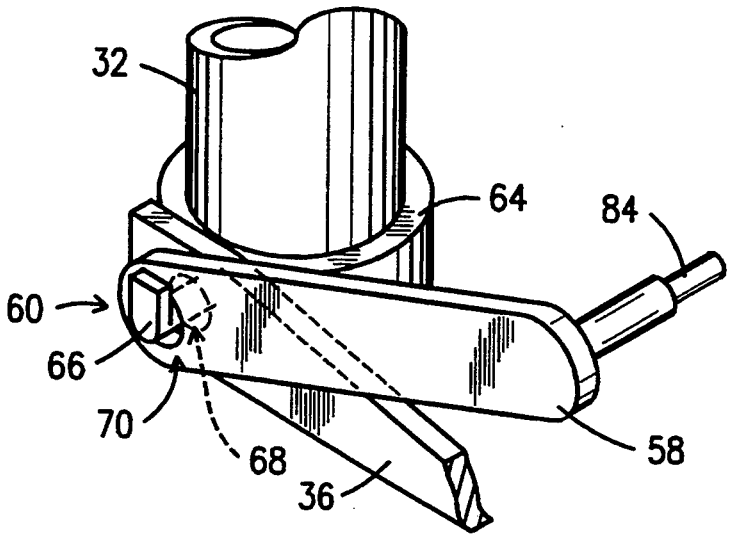
FIG. 6 is a perspective view of a first pivot means of the concentrically mounted, double pivot flush regulator.

As shown in FIG. 6, the first pivot means 60 comprises an annular mounting ring 64 operatively mounted on the lower portion of the overflow tube 32. A connecting member 66 extends outwardly from opposite sides of the annular mounting ring 64 to pass through apertures 68 and 70 formed on the inner end of the interconnecting member 36 and pivot arm 58 respectively to pivotally coupled the buoyant flapper valve 34 and pivot arm 58 to the overflow tube 32.

Figure 7:
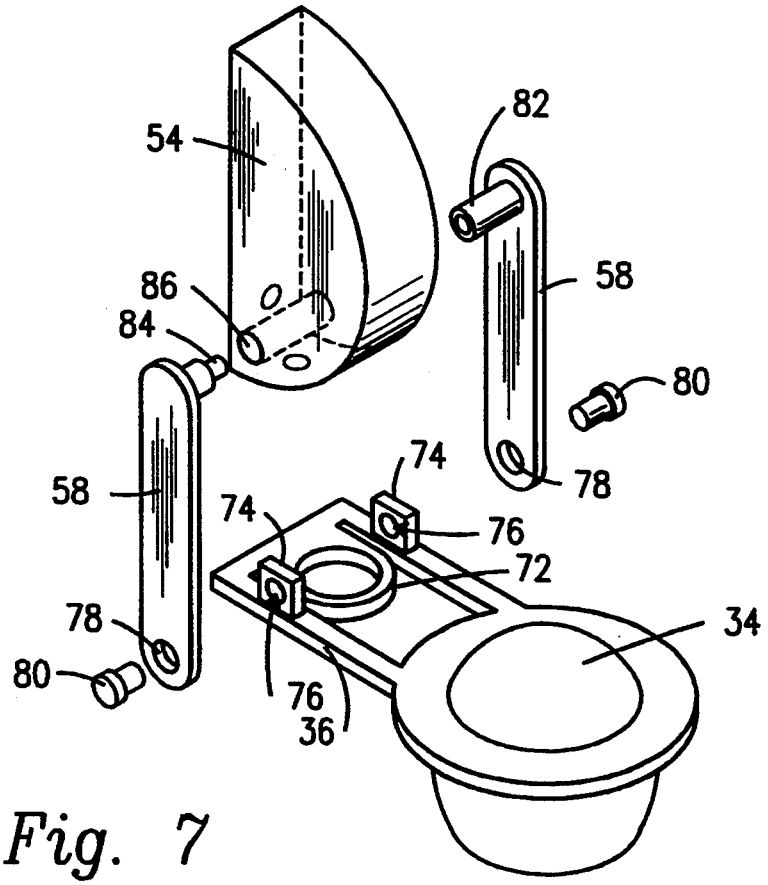
FIG. 7 is an exploded perspective view of an alternate embodiment of the first pivot means of the concentrically mounted, double pivot flush regulator.

As shown in FIG. 7, alternately the first pivot means 60 comprises an annular mounting ring 72 formed on the inner end of the interconnecting member 36 operatively mounted on the lower portion of the overflow tube 32 and mounting tabs 74 including an aperture 76 in combination with an aperture 78 formed on the inner end of each pivot arm 58 and a corresponding mounting pin 80 passed through the corresponding aperture 78 and the corresponding aperture 76 to pivotally couple the buoyant flapper valve 34 and pivot arms 58 to the overflow tube 32.

As best shown in FIG. 7, the second pivot means 62 comprises a hollow connector 82 and a connector pin 84 passing through an aperture 86 formed through the flush control member 54 and configured to operatively coupled to each other.

Figure 8:
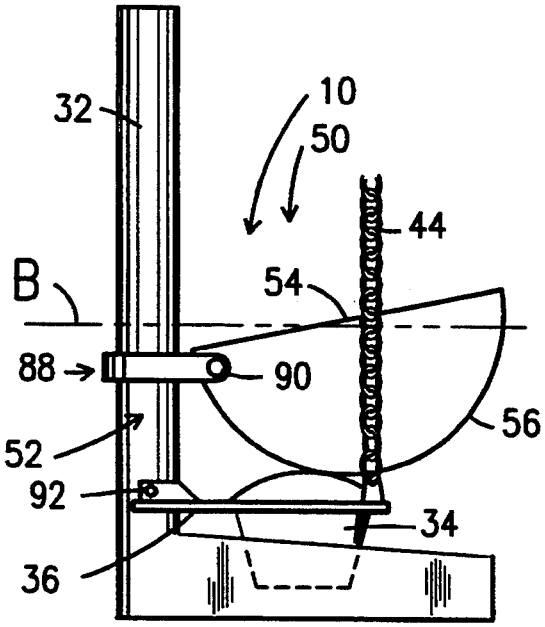
FIG. 8 is a side view of an eccentrically mounted, single pivot flush regulator completing a partial flush cycle with the flush control means in the second or lower position.
Figure 9:
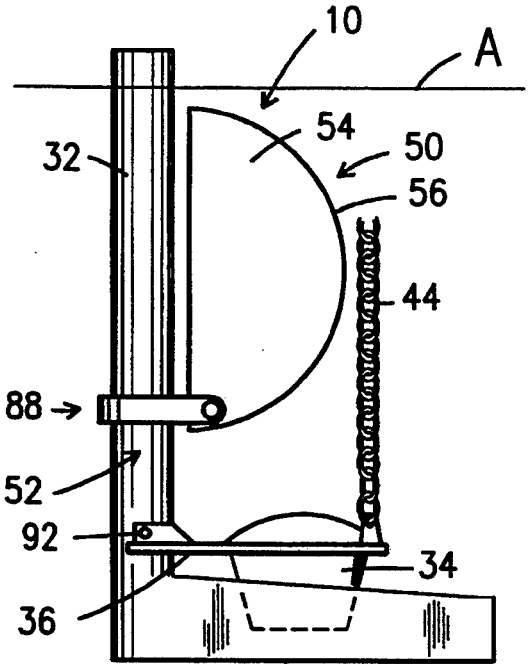
FIG. 9 is a side view of the eccentrically mounted, single pivot flush regulator with the flush control means in the first or upper position when the water storage tank is fully charged.

FIGS. 8 and 9 show an eccentrically mounted, single pivot flush regulator 10. Specifically, the flush control means 50 comprises a flush control member 54 including a lower convex surface 56 to engage the buoyant flapper valve 34 as described hereinafter and the mounting means 52 comprises a mounting element generally indicated as 88 coupled at one end thereof to the overflow tube 32 and pivotally coupled to the flush control member 54 at the opposite end thereof by a pivot means 90 similar to the second pivot means 62 disclosed in FIGS. 6 and 7 and in eccentric alignment with the pivot axis 92 of the buoyant flapper valve 34.

Figure 10:
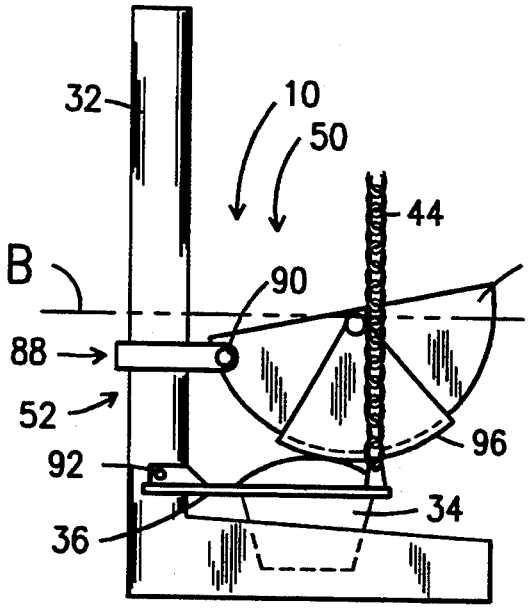
FIG. 10 is a side view of an alternate embodiment of an eccentrically mounted, single pivot flush regulator completing a partial flush cycle with the flush control means in the second or lower portion.
Figure 11:
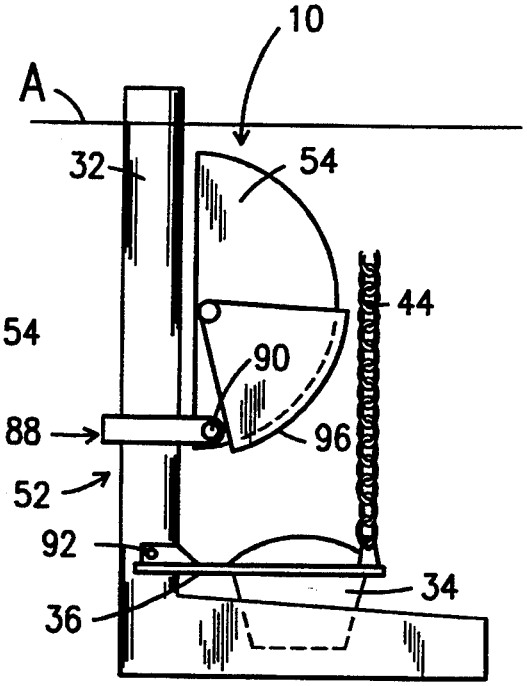
FIG. 11 is a side view of the alternate embodiment of the eccentrically mounted, single pivot flush regulator with the flush control means in the first or upper position when the water storage tank is fully charged.
Figure 12:
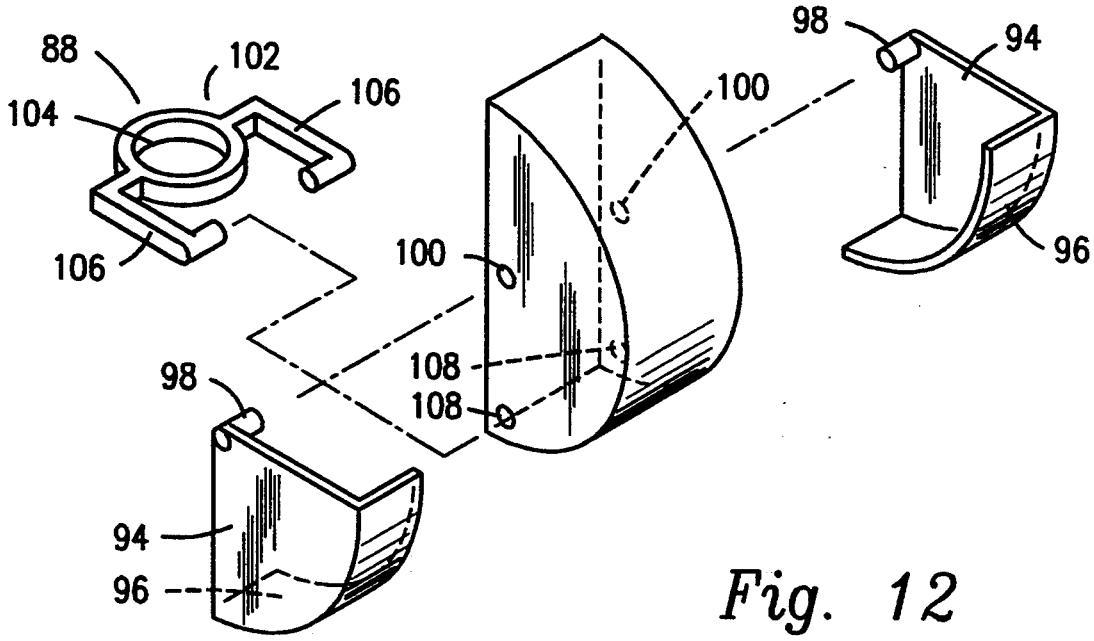
FIG. 12 is an exploded perspective view of the alternate embodiment of the eccentrically mounted, single pivot flush regulator shown in FIGS. 10 and 11.

FIGS. 10 through 12 show an alternate embodiment of an eccentrically mounted, single pivot flush regulator 10. Specifically, the flush control means 50 comprises a flush control member 54 including a lower convex surface 56 having a sleeve including a pair of sleeve members each indicated as 94 including a peripheral arcuate convex surface 96 pivotally coupled to opposite sides of the flush control member 54 by a pin 98 extending through corresponding apertures 100 formed on opposite sides of the flush control member 54 to engage the flapper valve 34 as described hereinafter. The mounting element 88 comprising a mounting bracket generally indicated as 102 including an annular mounting ring 104 coupled to the overflow tube 32 and a pair of mounting tabs each indicated as 106 coupled with to a corresponding pair of mounting apertures each indicated as 108 formed on opposite sides of the flush control member 54 disposed in eccentric alignment with the pivot axis 92 of the buoyant flapper valve 34.

Figure 13:
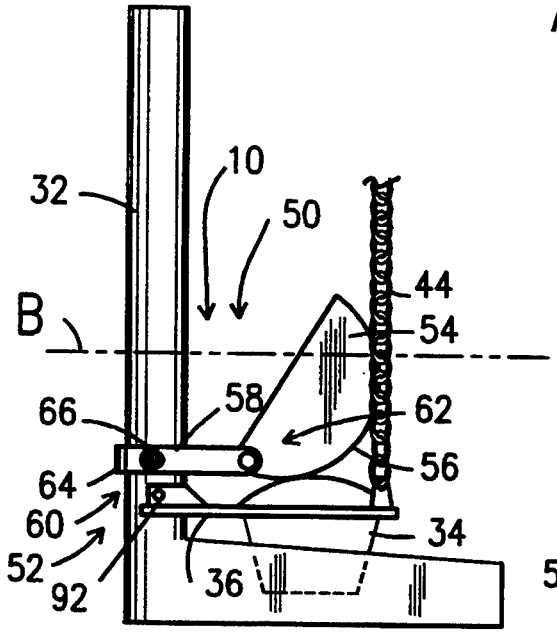
FIG. 13 is a side view of an eccentrically mounted, double pivot flush regulator completing of a partial flush cycle with the flush control means in the second or lower position.
Figure 14:
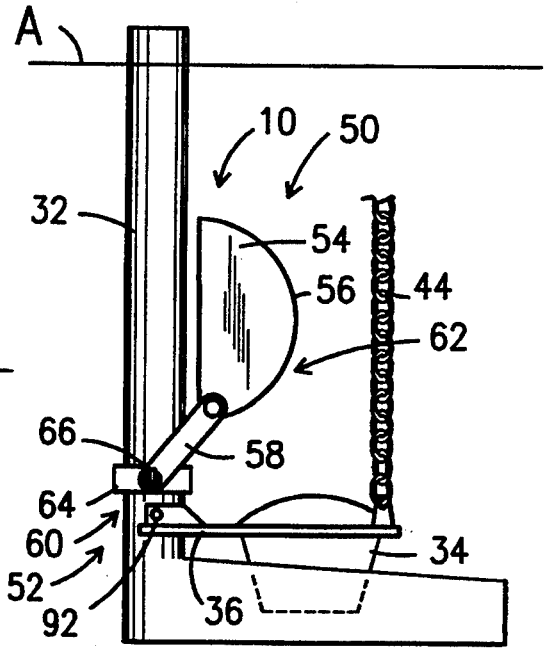
FIG. 14 is a side view of the eccentrically mounted, double pivot flush regulator with the flush control means in the first or upper position when the water storage tank is fully charged.

FIGS. 13 and 14 show an eccentrically mounted, double pivot flush regulator 10. Specifically, the flush control means 50 comprises a flush control member 54 including a lower convex surface 56 to engage the buoyant flapper valve 34 as described hereinafter and a mounting means 52 comprising at least one pivot arm 58 pivotally coupled at one end thereof to the overflow tube 32 by a first pivot means generally indicated as 60 similar to that shown in FIG. 6 and further including an annular mounting ring 64 in eccentric alignment with the pivot axis 92 of the flexible intermediate member 36 of the buoyant flapper valve 34 and pivotally coupled to the flush control member 54 at the opposite end thereof by a second pivot means generally indicated as 62 similar to that shown in FIGS. 6 and 7.

FIGS. 15 through 21 show a flush control member including various buoyance control means to selectively control the weight and/or buoyance thereof.

Figure 15:
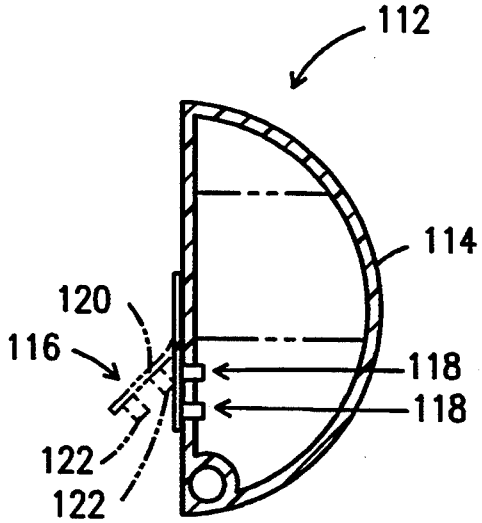
FIG. 15 is a cross-section view of a flush control means including a buoyance control means to selectively control the air/water ratio and buoyance thereof.

As shown in FIG. 15, the flush control member 112 comprises a hollow body 114 and a buoyance control means generally indicated as 116. The buoyance control means 116 comprises at least one aperture 118 formed on the upper portion of the hollow body 114 and a sealing cap 120 including a corresponding closure pin 122 to selectively seal the corresponding aperture 118. This permits the selective addition of water or other weight creating means to the hollow body 114 to control the weight and buoyance of the flush control member 112 through the aperture 118.

Figure 16:
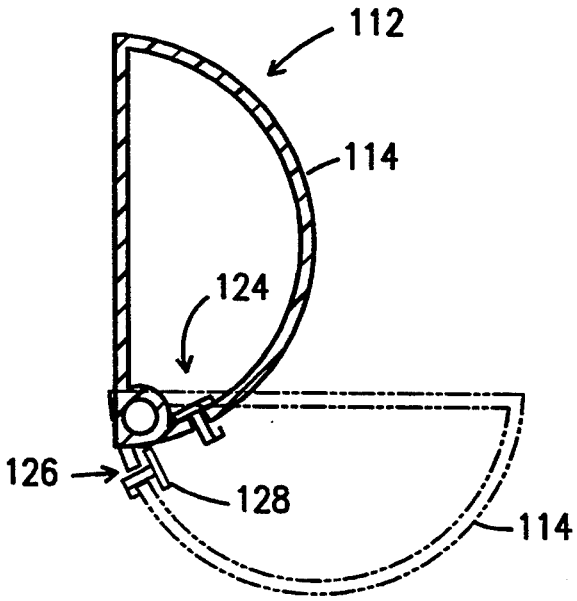
FIG. 16 is a cross-section view of an alternate embodiment of a flush control means including a buoyance control means to selectively control the air/water ratio and buoyance thereof.

As shown in FIG. 16, the flush control member 112 comprises a hollow body 114 and a buoyance control means generally indicated as 124. The buoyance control means 124 comprises an aperture 126 formed on the lower portion of the hollow body 114 and a one-way check valve 128 to selectively seal the aperture 126. This permits the addition of water to the hollow body 114 to control the weight and buoyance of the flush control member 114 by depressing and forcing the hollow body 114 into the water to add water to the hollow body 114.

Figure 17:
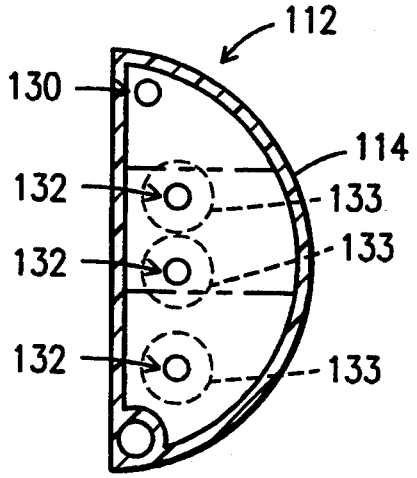
FIG. 17 is a cross-section view of another alternate embodiment of a flush control means including buoyance control means to selectively control the air/water ratio and buoyance thereof.

As shown in FIG. 17, the flush control member 112 comprises a hollow body 114 having an air vent 130 formed therein and a buoyance control means comprising a plurality of apertures each indicated as 132 formed on the upper portion thereof including a corresponding plurality of closure means such as removable adhesive strips each indicated as 133 to selectively seal one or more of the apertures 132. This permits the addition of water to the hollow body 114 to control the weight and buoyance of the flush control member 112 by opening one or more of the apertures 132 such that the hollow body 114 allows water to flow to and from the hollow body 114 as the hollow body 114 rotates during the flush and fill cycles.

Figure 18:
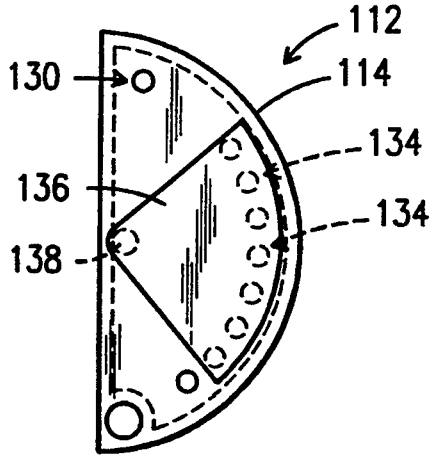
FIG. 18 is a cross-section view of yet another alternate embodiment of a flush control means including a buoyance control means to selectively control the air/-water ratio and buoyance thereof.

As shown in FIG. 18, the flush control member 112 comprises a hollow body 118 having an air vent 130 formed therein and a buoyance control means comprising a plurality of apertures each indicated as 134 formed on the lower portion thereof and a sealing member or plate 136 rotatably attached to the side of the hollow body 114 by a connecting pin 138. This permits the addition of water to the hollow body 114 to control the weight and buoyance of the flush control member 112 by selectively rotating the sealing member or plate 136 to selectively seal or close one or more of the apertures 134 to control the flow of water to and from the hollow body 114 during the flush and fill cycles.

Figure 19:
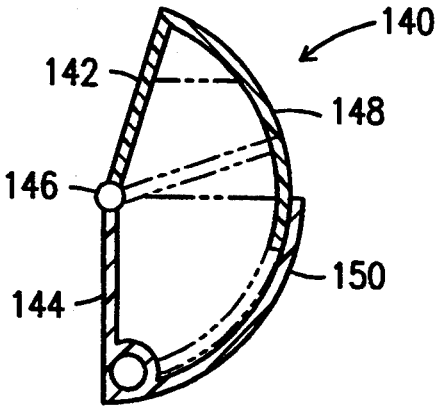
FIG. 19 is a cross-section view of a flush control means including a buoyance control means to vary the volume and buoyance thereof.
Figure 20:
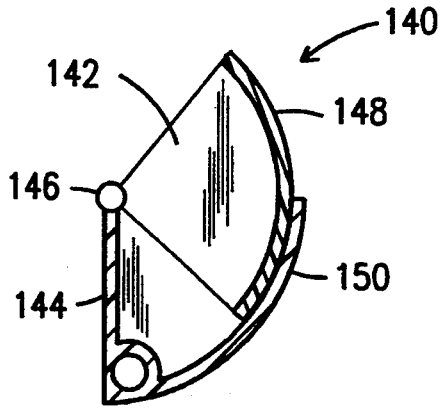
FIG. 20 is a cross-section view of an alternate flush control means including a buoyance control means to vary the volume and buoyance thereof.
Figure 21:
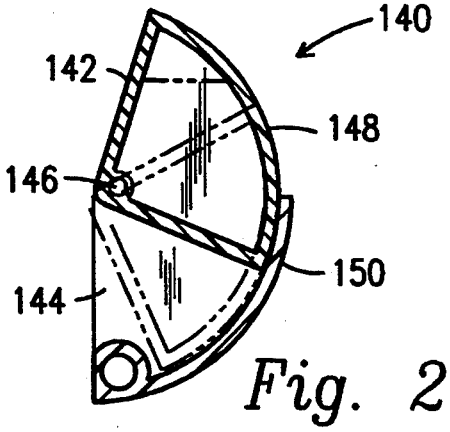
FIG. 21 is a cross-section view of an yet another flush control means including a buoyance control means to vary the volume and buoyance thereof.

As shown in FIGS. 19 through 21, the flush control member generally indicated as 140 comprises a first and second flush control element indicated as 142 and 144 respectively pivotally coupled to each other by a connecting means 146 to permit relative movement therebetween. The lower surfaces 148 and 150 of the first and second flush control element 142 and 144 respectively are sized and configured to form a friction fit between the first and second flush control element 142 and 144 to retain the relative position therebetween when manually adjusted or moved. By positioning the first and second flush control elements 142 and 144 relative to each other, the volume of tank water displaced is controlled thereby controlling the buoyance of the flush control member 140.

FIGS. 22 through 29 show different flush control regulators 10 including a bleach/detergent dispensing means. In each embodiment, water enters and leaves the dispersing means through apertures or slots to disperse bleach and/or detergent into the water storage tank 14.

Figure 22:
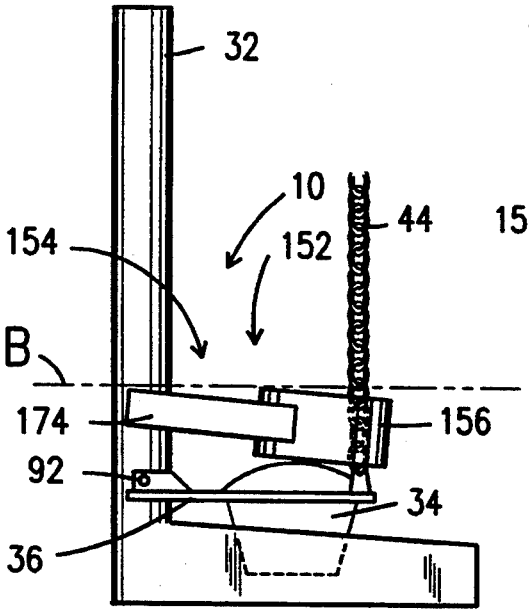
FIG. 22 is a side view of an eccentrically mounted, single pivot flush regulator including a dispensing means completing a partial flush cycle with the flush control means in the second or lower position.
Figure 23:
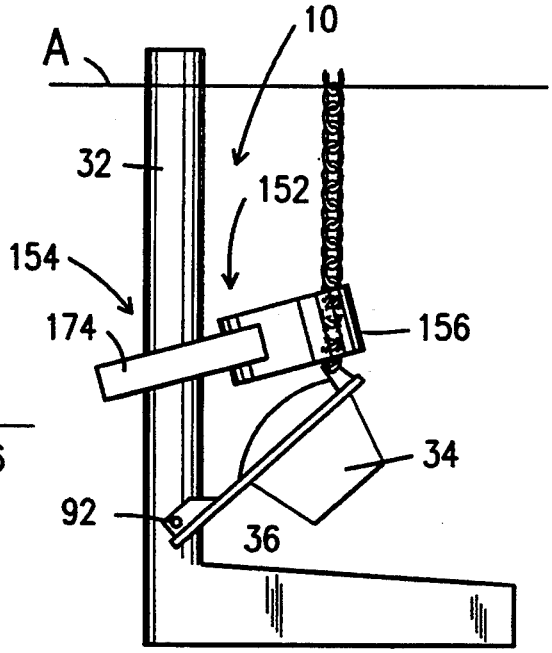
FIG. 23 is a side view of the the eccentrically mounted, single pivot flush regulator including the dispensing means with the flush control means in the first or upper position when the water storage tank is fully charged with the buoyant flapper valve in the upper or second position at the start of the flush cycle.
Figure 24:
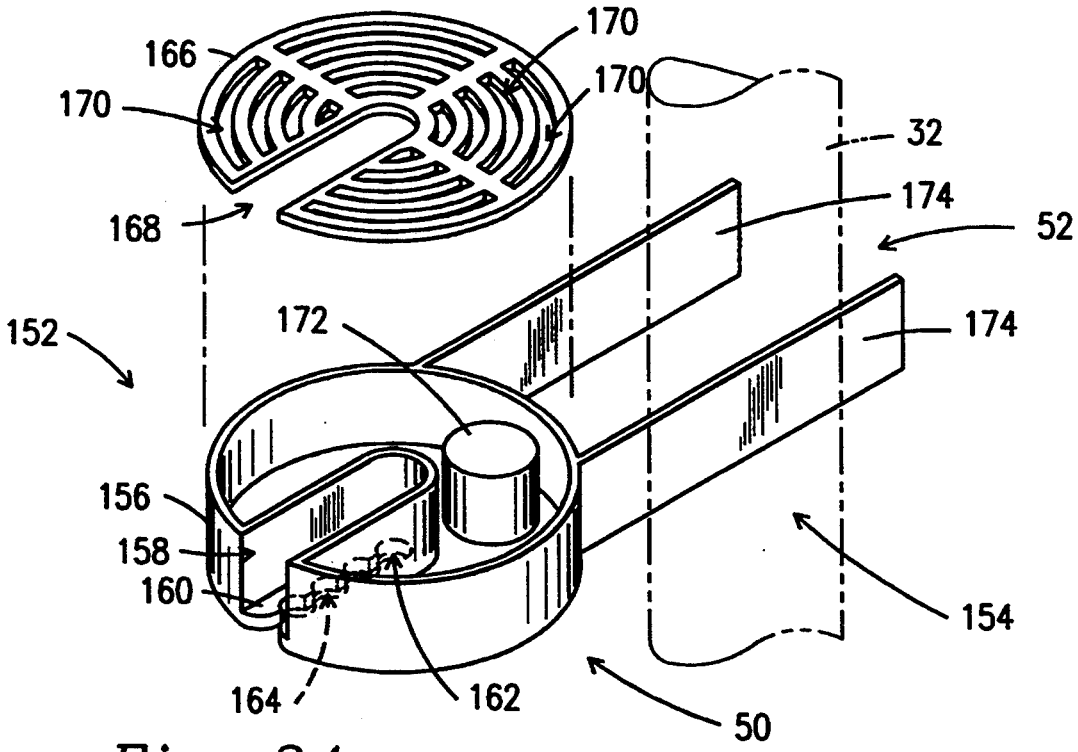
FIG. 24 is an exploded view of the the eccentric mounted, single pivot flush regulator including the dispensing means shown in FIGS. 22 and 23.

FIGS. 22 through 24 show an eccentrically mounted, single pivot flush regulator 10 including a bleach/detergent dispensing means. Specifically, the flush control means 50 comprises a flush control member generally indicated as 152 to engage the buoyant flapper valve 34 as described hereinafter and a mounting means generally indicated as 154. The flush control member 152 comprises a hollow body 156 including a channel 158 formed in the side thereof having a plate 160 including a series or plurality of mounting apertures each indicated as 162 interconnected by interconnecting slots or passages each indicated as 164 to receive the flexible interconnecting element 44 therethrough, and a top or cap 166 removably mounted to the top of the hollow body 156 including a slot 168 disposed in registry with the channel 158 and a plurality of dispensing apertures 170 formed therethrough to cooperatively retain a cake 172 of bleach and/or detergent therein. The mounting means 154 comprises a pair of mounting arms or elements each indicated as 174 extending outwardly from the hollow body 156 disposed on opposite sides of the overflow tube 32.

Figure 25:
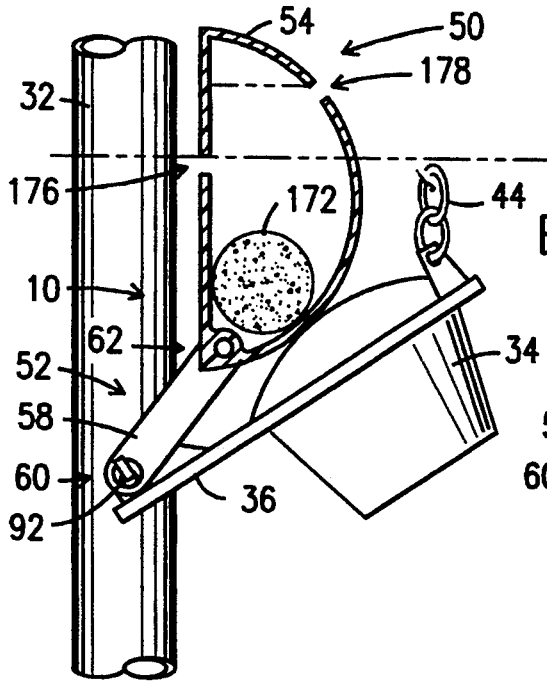
FIG. 25 is a cross-sectional side view of a eccentrically mounted, double pivot flush regulator including a dispensing means with the flush control means in the first or upper position when the water storage tank is fully charged with the buoyant flapper valve in the upper or second position at the start of the flush cycle.
Figure 26:
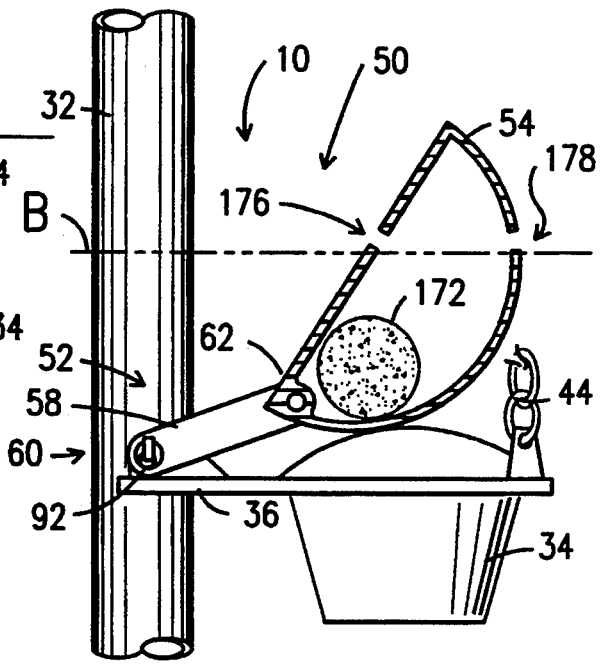
FIG. 26 is a cross-sectional side view of the eccentrically mounted, double pivot flush regulator including the dispensing means completing a partial flush cycle with the flush regulator in the second or lower position.

FIGS. 25 and 26 show a concentrically mounted, double pivot disposable flush regulator 10 including a dispensing means. Specifically, the flush control means 50 comprises a hollow flush control member 54 having a bleach/detergent cake 172 disposed therein and including first aperture or vent 176 formed in the upper portion thereof and a second aperture or vent 178 formed in a lower convex surface 56 to engage the buoyant flapper valve 34 as described hereinafter. The mounting means 52 comprises at least one pivot arm 58 pivotally coupled at one end thereof to the overflow tube 32 by a first pivot means generally indicated as 60 in concentric alignment with the pivot axis 92 of the flexible intermediate member 36 of the buoyant flapper valve 34 and pivotally coupled to the flush control member 54 at the opposite end thereof by a second pivot means generally indicated as 62.

Figure 27:
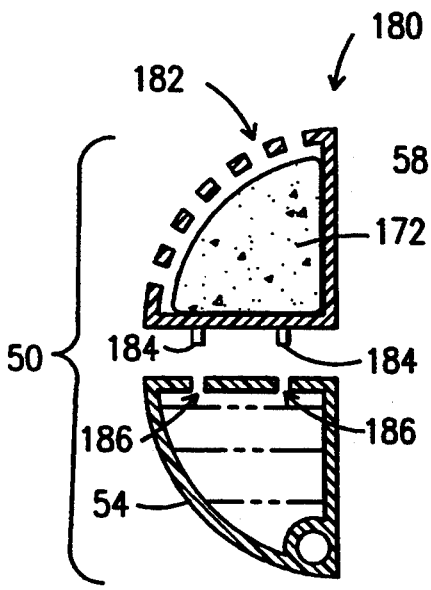
FIG. 27 is a cross-sectional view of an alternate embodiment of the dispensing means.

FIG. 27 shows a flush control means 50 comprising a hollow flush control member 54 and a replacable dispenser means comprising a hollow dispenser member 180 including a plurality of apertures each indicated as 182 formed in the periphery thereof to house or retain a cake 172 of bleach and/or detergent. The hollow dispenser member 180 is detachably coupled to the hollow flush control member 54 by a plurality of connecting pins each indicated as 184 press fitted into corresponding apertures each indicated as 186 formed in the hollow flush control member 54.

Figure 28:
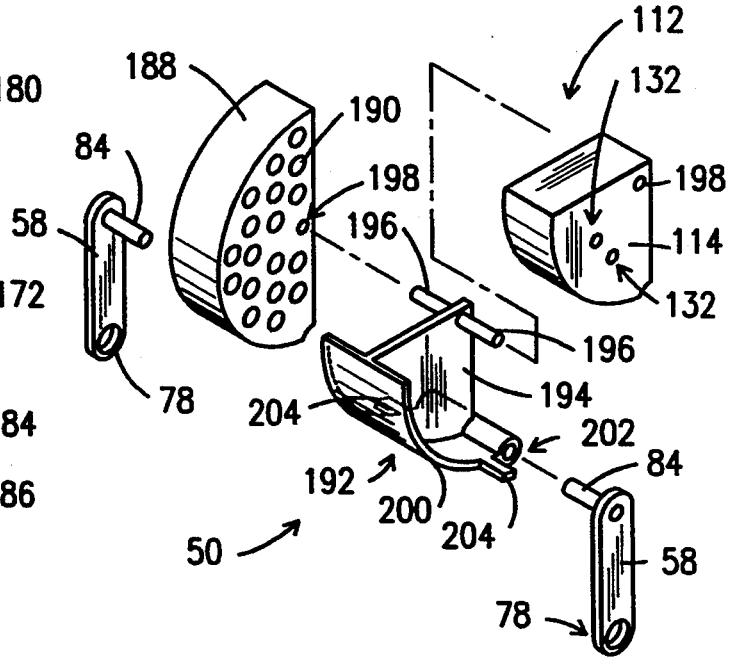
FIG. 28 is an exploded view of another alternate embodiment of the dispensing means.

FIG. 28 shows a flush control means 50 comprising a flush control member 112 similar to the flush control member 112 shown in FIG. 17 and a replacable dispensing means comprising hollow dispenser member 188 including a plurality of apertures each indicated as 190 to house or retain bleach and/or detergent therein mounted on a frame generally indicated as 192. The frame 192 comprises a base plate 194 having a mounting member 196 extending outwardly from opposite sides thereof to receive a mounting aperture 198 formed in the flush control member 112 and hollow dispenser member 188 and a support flange 200 disposed relative to the mounting member 196 to engage and support the flush control member 112 and hollow dispenser member 188. A connector or coupling member 202 extends outwardly from opposite sides of the base plate 194 to receive a corresponding connecting pin 84 similar to the mounting means shown in FIGS. 6 and 7. A stop or limit member 204 is disposed adjacent each connector or coupling member 202 to engage the corresponding pivot arm 58.

Figure 29:
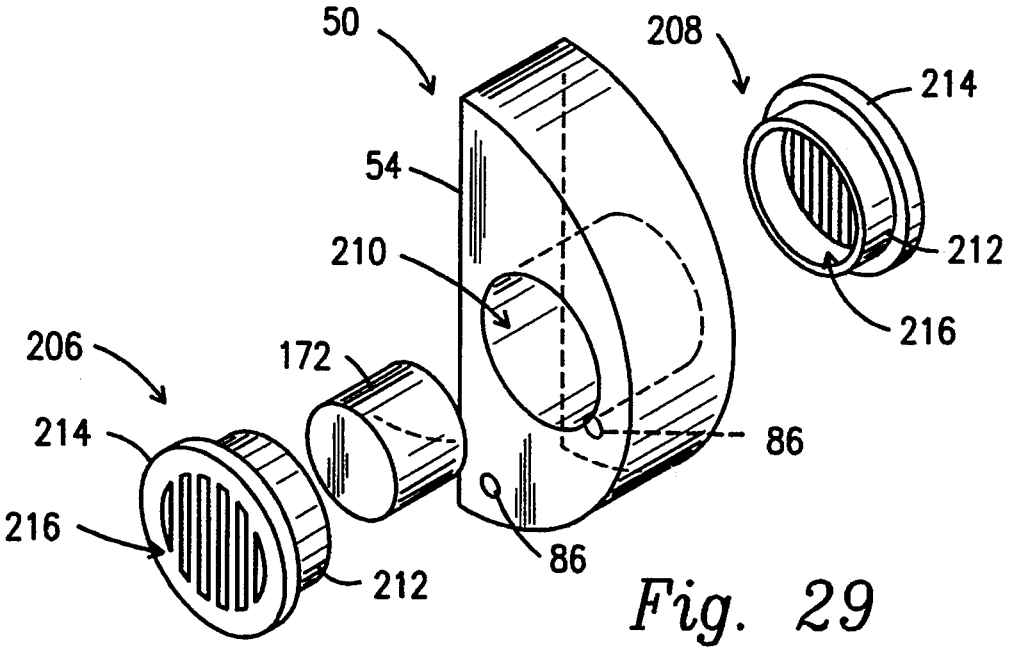
FIG. 29 is an exploded view of yet another alternate embodiment of the dispensing means.

FIG. 29 shows a flush control means 50 comprising a hollow flush control member 54 and a replacable dispensing means comprising a first and second dispenser element generally indicated as 206 and 208 respectively configured to be removably mounted within a retaining channel 210 formed through opposite sides of the hollow flush control 54. Specifically, the first and second dispenser element 206 and 208 each comprises an inner cylindrical sleeve 212 to cooperatively form a chamber to operatively house the cake 172 with the retaining channel 210 and an outer cap 214 each including a plurality of slots or apertures each indicated as 216.

As shown in FIG. 1, when the water storage tank 14 is fully charged, the water level A will support the float member 26 causing the buoyant flapper valve 32 to seal the flush outlet 40. In use, the buoyant flapper valve 32 is moved to the open position as shown in phantom in FIG. 30 by actuating the flush handle 46 engaging the flush control means 50. The combined buoyance of the flush regulator 10 and buoyant flapper valve 34 is less than the buoyance of the buoyant flapper valve 34. Thus as water flows from the water storage tank 14 through the flush outlet 40, the flush control means 50 forces or causes the buoyant flapper valve 34 to prematurely return to sealing relationship with the flush outlet 40 resulting in a partial flush of a reduced volume of water shown as B in FIG. 1.

To operate in the full flush mode, the flush handle 46 is moved and held in the second position until the water is flushed from the water storage tank 14 as indicated by C in FIG. 1.

As shown in FIGS. 22 through 29, movement of the flush control means 50/152 during the flush cycle causes water to flow therethrough to disperse bleach and detergent therefrom.

Figure 30:
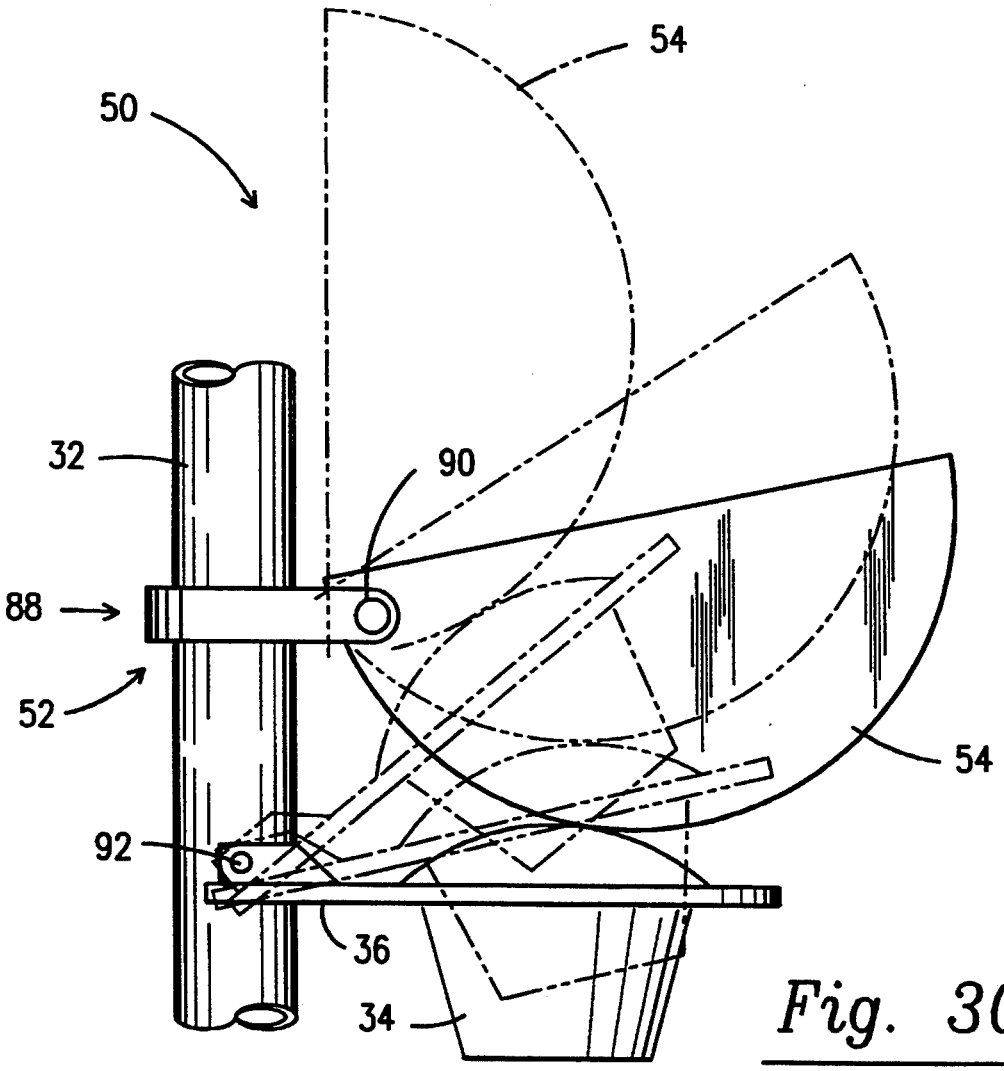
FIG. 30 is a side view of the eccentrically mounted, single pivot flush regulator at various stages of the flush cycle.

As shown in FIG. 30, the lower surface 56 of the flush control member 54 slidingly engages the upper surface of the buoyant flapper valve 34 during the flush cycle. As shown in FIGS. 10 through 12, the arcuate convex surface 96 of the sleeve member 94 are provided to reduce sliding friction between the flush control member 54 and the buoyant flapper valve 34.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A flush regulator selectively operable in a partial flush mode or a full flush mode for use with a water closet including a water storage tank having an overflow tube disposed therein and a flush drain aperture formed in a lower portion thereof and a buoyant flapper valve pivotally coupled to the overflow tube by an interconnecting member about a pivot axis disposed to selectively seal the flush drain aperture and movable between a closed position and an open position by a flush handle movable between a first and second position to selectively control the flow of water from the water storage tank through the flush drain aperture, said flush regulator comprising a flush control member including mounting means for pivotally coupling the flush control member to the overflow tube to be movable between an upper position and a lower position, said flush control member adapted to be disposed within the water storage tank to selectively engage the buoyant flapper valve such that when the flush handle is moved from the first position to the second position and released said flush control member engages the buoyant flapper valve in the open position to force the buoyant flapper valve to prematurely return to the closed position to operate in the partial flush mode to discharge a first volume of water and when the flush handle is moved from the first position to the second position and held in the second position the buoyant flapper valve is held in the open position to operate in the full flush mode to discharge a second volume of water, said mounting means comprising at least one pivot arm adapted to be pivotally mounted within the water storage tank in substantially concentric alignment with the pivot axis of the buoyant flapper valve and fixedly coupled to said flush control member at an opposite end thereof.

2. The flush regulator of claim 1 wherein the mounting mean includes an annular mounting ring having at least one connecting member extending outwardly from one side thereof to pass through apertures formed on an inner end of the buoyant flapper valve and said pivot arm to pivotally couple the buoyant flapper valve and said pivot arm to the overflow tube.

3. The flush regulator of claim 1 wherein an inner end of the interconnecting member of the buoyant flapper valve is operatively mounted on a lower portion of the overflow tube by an annular mounting ring and includes at least one mounting tab including an aperture formed therethrough and said pivot arm includes an aperture formed on an inner end thereof to receive a mounting pin passed through said apertures to pivotally coupled said pivot arm to the overflow tube.

* * * * *